US006174395B1

(12) United States Patent
Soriano

(10) Patent No.: US 6,174,395 B1
(45) Date of Patent: Jan. 16, 2001

(54) AUTOMATED METHOD OF TAPING A HARNESS, AND A MACHINE THEREFOR

(75) Inventor: Louis Soriano, Aubagne (FR)

(73) Assignee: Komax Holding AG, Dierikon (CH)

( * ) Notice: Under 35 U.S.C. 154(b), the term of this patent shall be extended for 0 days.

(21) Appl. No.: 09/142,387

(22) PCT Filed: Mar. 20, 1997

(86) PCT No.: PCT/IB97/00273

§ 371 Date: Sep. 2, 1998

§ 102(e) Date: Sep. 2, 1998

(87) PCT Pub. No.: WO97/36304

PCT Pub. Date: Oct. 2, 1997

(51) Int. Cl.[7] ..... B65H 31/06
(52) U.S. Cl. ..... 156/187; 156/350; 156/429
(58) Field of Search ..... 156/185, 187, 156/189, 191, 192, 195, 425, 428, 429, 350, 446, 458, 475; 100/5, 17, 18, 27; 53/399, 589; 242/439, 448, 448.1, 444.4, 444.5; 174/72 A

(56) References Cited

U.S. PATENT DOCUMENTS 4,982,560 1/1991 Vives et al. ..... 57/10
5,182,894 * 2/1993 Bate ..... 53/399
5,732,750 * 3/1998 Soriano ..... 140/92.1

FOREIGN PATENT DOCUMENTS 0 285 045-A1 10/1988 (EP) .
WO 95/00989 1/1995 (WO) .

* cited by examiner

*Primary Examiner*—Mark A. Osele
*Assistant Examiner*—George R. Koch
(74) *Attorney, Agent, or Firm*—Cohen, Pontani, Lieberman & Pavane

(57) ABSTRACT

A taping section of a harness making machine comprises a taping device, two conveyors and a bridging conveyor positioned therebetween. The bridging conveyor allows passage of pallets that carry nodes of a harness from the first conveyor to the second conveyor. Once a node has passed over from the first to the second conveyor, the bridging conveyor is vertically removed by the piston rod to allow the taping device to be positioned between the conveyors. The harness is received in a slot of the taping device which tapes the harness whilst it is axially moved by the conveyors until the second pallet reaches the taping device. The taping device is removed, the bridging conveyor inserted and the procedure continues as described above for taping the second section of of harness between the nodes. A simple automated procedure for taping harnesses is thus provided.

6 Claims, 6 Drawing Sheets

AUTOMATED METHOD OF TAPING A HARNESS, AND A MACHINE THEREFOR

BACKGROUND OF THE INVENTION

1. Field of the Invention

This invention relates to a method of taping a harness comprising a bundle of cables, and a machine therefor.

2. Summary of the Prior Art

In French patent application FR 2 707 828, a method and apparatus for making a harness comprising electrical wires or other types of wires is described. The method described in the latter patent is particularly adapted for linear harness making machines comprising conveyor systems arranged in a straight line, that transport the harness therealong for processing. In the latter patent, the method is particularly concerned with manufacturing of a complex harness with a number of branches leading to various connection ends, where branches are held together at their joining points or nodes. In order to neatly branch off wires at a node, the harness is taped or tied at the nodes. Long sections of wires between nodes are however not held together, although the harness could be taped at intermediate positions between the nodes. It is however desirable in certain applications to keep the wires bundled together along the whole length between nodes, as exposed individual wires can get: caught on external objects. It may also be desirable to tape the whole harness with a protective layer to prevent damage to individual wires.

In the event that taping of the whole harness is desired, it is typical to take a harness, for example which is prepared by the method in the above mentioned patent, or which is manufactured manually on a wiring board, and transport the harness to a taping machine. A known taping device 10 is shown in FIGS. 1*a* and 1*b*. The device comprises a static support 1 with a bearing 6, within which a large wheel 2 is rotatably mounted, further comprising a tape roll 3 mounted on an axis 7 pivotally to the wheel 2 and comprising a tape 5. The tape is spiralled around a section 4 of harness comprising a plurality of wires (not shown). The wheel 2 and support 1 have a U-shaped slot 8 to enable the harness section 4 to be positioned in alignment with the axis of the wheel. The wheel can then be rotated in the rotation direction R whilst the harness is fed in the axial direction such that the tape unrolls from the roll 3 and winds in a spiral around the harness.

The section of harness to be taped, is supported typically by two grippers at either end, for example, positioned proximate nodes of the harness, the grippers being pulled apart to straighten the cable. The harness is manually fitted to the grippers, but the axial feeding and rotation of the wheel may be motor driven. The above method only enables a single section of harness between nodes to be taped, without intervention of an operator. An operator has to remove and reset the tape in the grippers when another section of the cable between different nodes, must be taped. This is a labour intensive and therefore costly procedure.

Due to the complexity of certain harnesses with different numbers of nodes and branches and lengths of harness between the nodes, a solution for automating the taping procedure in a sufficiently simple and viable manner has not been found. Intervention of an operator to reposition the harness on the guides for each section of harness between nodes has the advantage of at least being a simple procedure with great flexibility (i.e. different cables can be easily treated in small production runs). A further problem of the prior method, is also the possibility of inconsistent quality and therefore in certain cases defects in the harness.

It would however be desirable to render the harness making procedure less labour intensive, in a cost effective manner, whilst ensuring flexibility, simplicity and reliability of the harness making procedure.

SUMMARY OF THE INVENTION

It is therefore an object of this invention to provide a method of producing a harness that is taped at least along certain lengths thereof, in a cost effective yet reliable and rapid manner.

It is an object of this invention to provide an automated method for taping a complex harness, at least along certain sections of length.

It would be advantageous to provide a simple, automated taping method for a linear harness making machine.

It is an object of this invention to provide a machine to carry out the above mentioned methods.

The objects of this invention have been achieved by a method of taping a harness having a section extending between nodes that are transported by support means on a harness transport system, which method comprises the steps of supporting the nodes on support means, transporting the support means and the harness on a harness transport system having a first conveyor and a second conveyor, transferring a first node of a first harness to be taped from the first conveyor to the second conveyor, inserting a taping device between the first and second conveyors, and taping the harness section. The inventive objects are further achieved by an automated harness making machine adapted to carry out the preceding method, which machine has a taping section which comprises a harness transport system for transporting a harness, and a taping device for taping sections of the harness. The transport system comprises pallets or grippers to hold the harness at nodes and the first conveyor and the second conveyor. The taping device is insertable between the conveyors for taping the sections of the harness and removable from between the conveyors to allow passage of the pallets or grippers from the first conveyor to the second conveyor. Advantageously, the taping of sections of a harness that is complex with many nodes and different lengths of harness between nodes, can be taped in a fully automated manner, yet in a reliable and cost effective manner. The method enables incorporation of a taping device in a known linear harness making machine without extensive redesign. This is particularly advantageous as the known linear harness making machine carrying out the invention described in FR 2 707 828 is able to produce complex harnesses, and the ability to integrate taping of such harnesses in a machine adapted to carry out such a method provides a particularly simple and flexible harness making procedure that is fully automated.

Other advantageous aspects of this invention are apparent from the following description, and the claims.

DETAILED DESCRIPTION OF THE PREFERRED EMBODIMENT

Figure 1B:
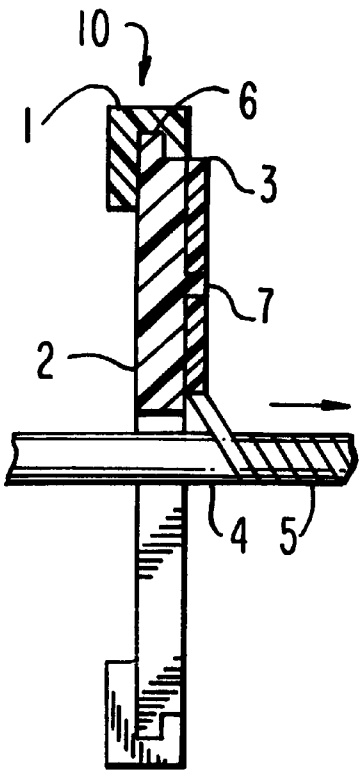
FIG. 1b PRIOR ART
Figure 1A:
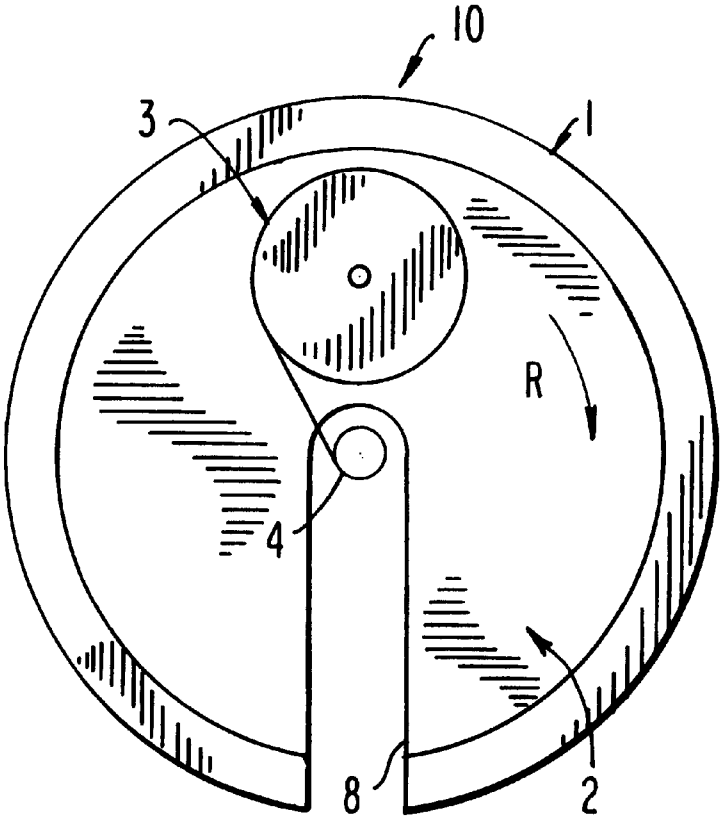
FIG. 1a PRIOR ART
Figure 2:
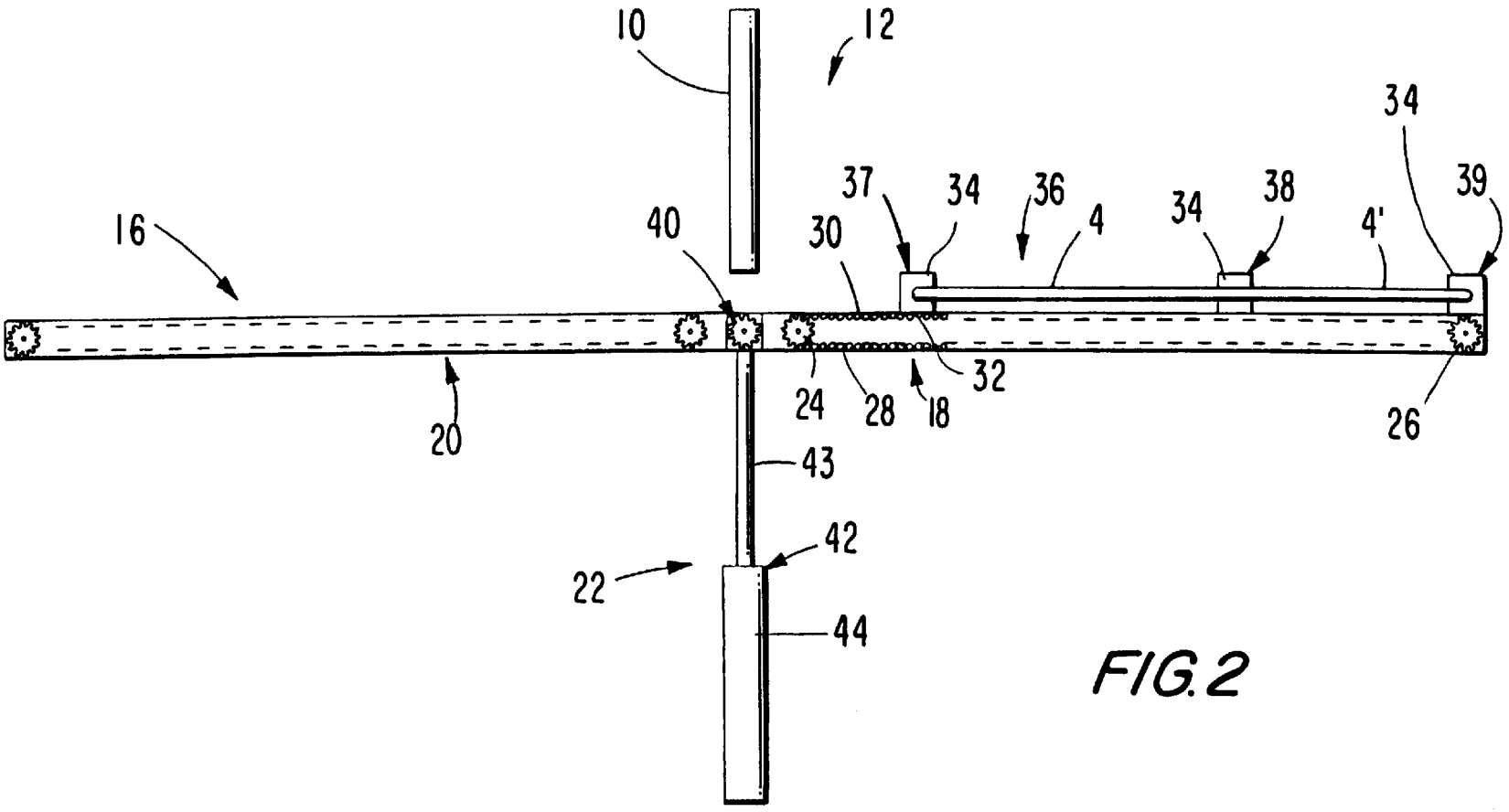
FIG. 2 is a schematic side view of part of the harness making machine according to this invention.

Referring to FIG. 2, a taping section 12 of a harness making machine is shown comprising a taping device 10 similar to that already described above and illustrated in FIGS. 1*a* and 1*b*, and a harness transport system 16 having a first conveyor 18, a second conveyor 20, and a bridging conveyor 22. The conveyors 18 and 20 are of a similar construction and comprise cogs 24,26 at either end that support a flexible belt 28 that has teeth 30 for engaging in teeth 32 of pallets 34 that support connectors, or ends of branches of a harness 36. The pallet members 34 may also be grippers for holding the harness at the nodes 37,38,39. Between the nodes 37,38 and 38,39 are harness sections 4 and 4' to be taped.

Between the first conveyor 18 and the second conveyor 20, is a gap that is bridged by the conveyor bridging member 22 which comprises a cog 40 that enables transport of the pallets 34 from the first conveyor 18 to the second conveyor 20. Such transfer of pallets from one belt to another over a cog in a linear manner, is known, and for example described in FR 2 707 828. The bridging conveyor member 22 further comprises a displacement means 42 comprising a piston rod 43 actuated by a piston 44, wherein the bridging cog 40 is supported on the piston rod 43. The piston 44 can be actuated to displace the cog 40 below the conveyors 18,20 thus providing a gap between the conveyors.

The taping device 10 is positioned in vertical alignment with the bridging cog 40 and has a sufficiently small thickness to fit in the gap between the first and second conveyors 18,20 respectively. All movements of the various parts such as conveyors, piston and taping device can be coordinated by computer control means. The taping device 10 can also be displaced by piston means or any other known mechanical means.

Figure 3A:
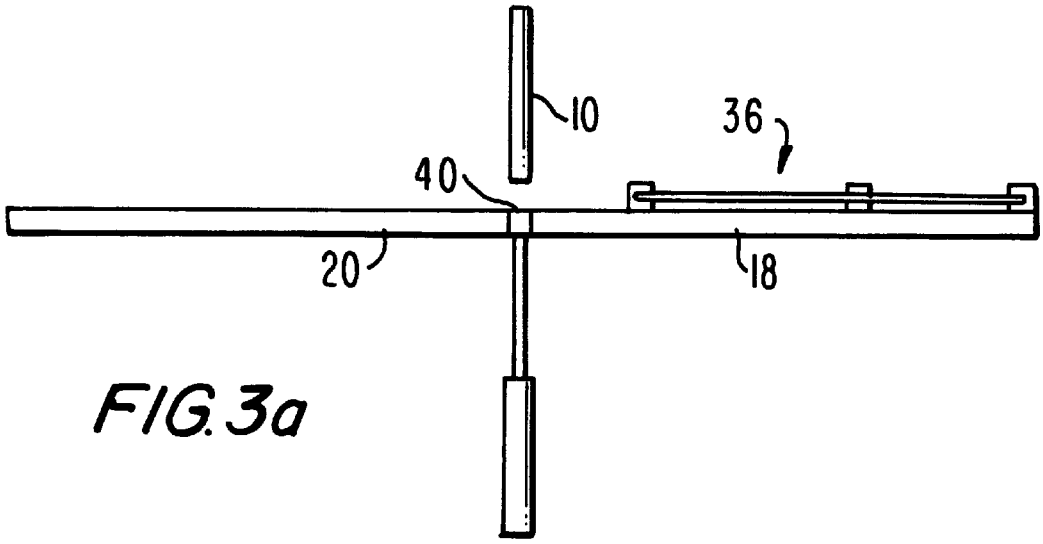
FIGS. 3*a* to 3*j* are views similar to that of FIG. 2 illustrating the various steps in the automated taping of a harness.
Figure 3B:
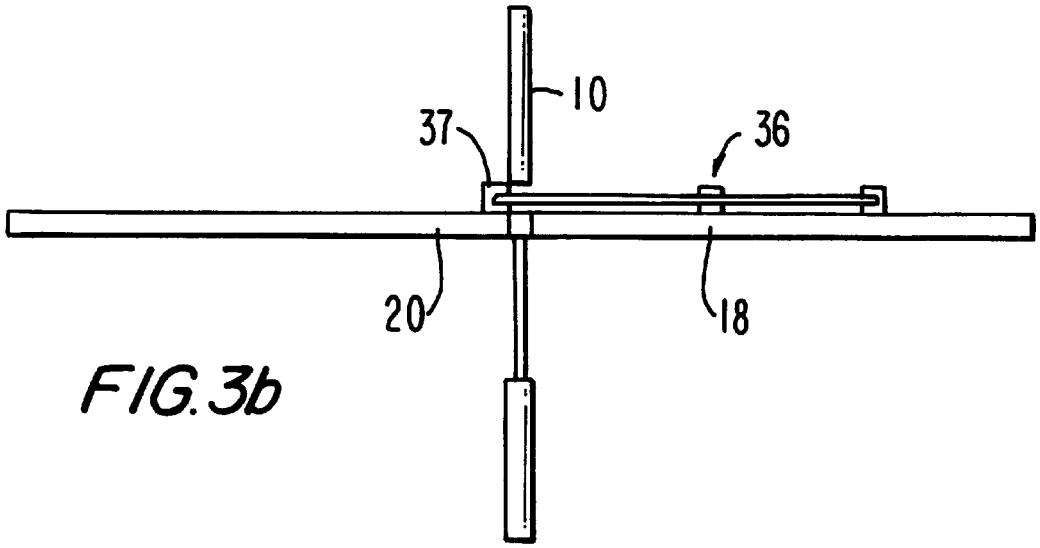
Figure 3C:
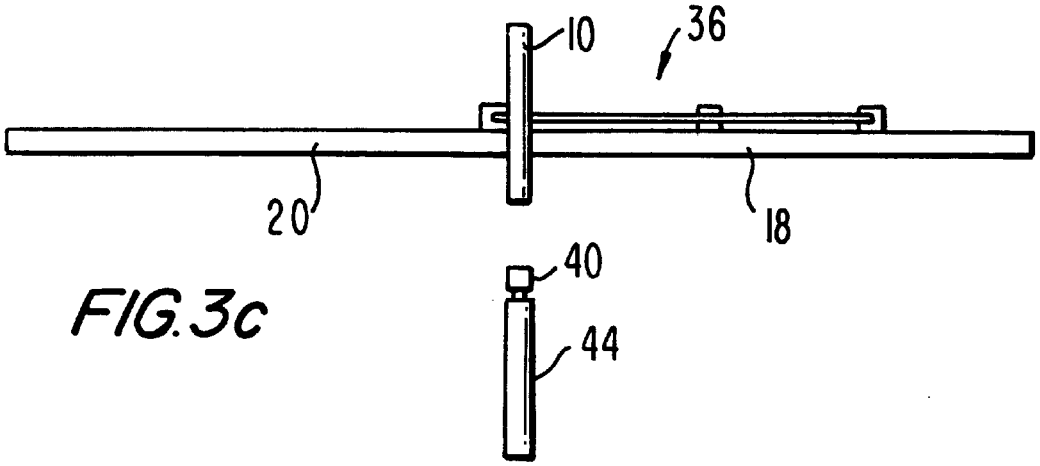
Figure 3D:
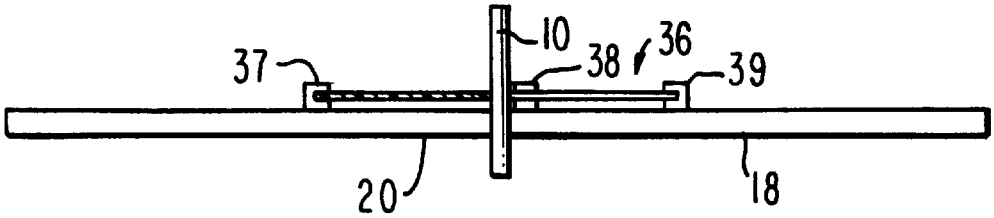
Figure 3D:
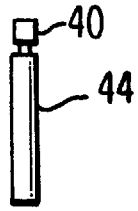
Figure 3E:
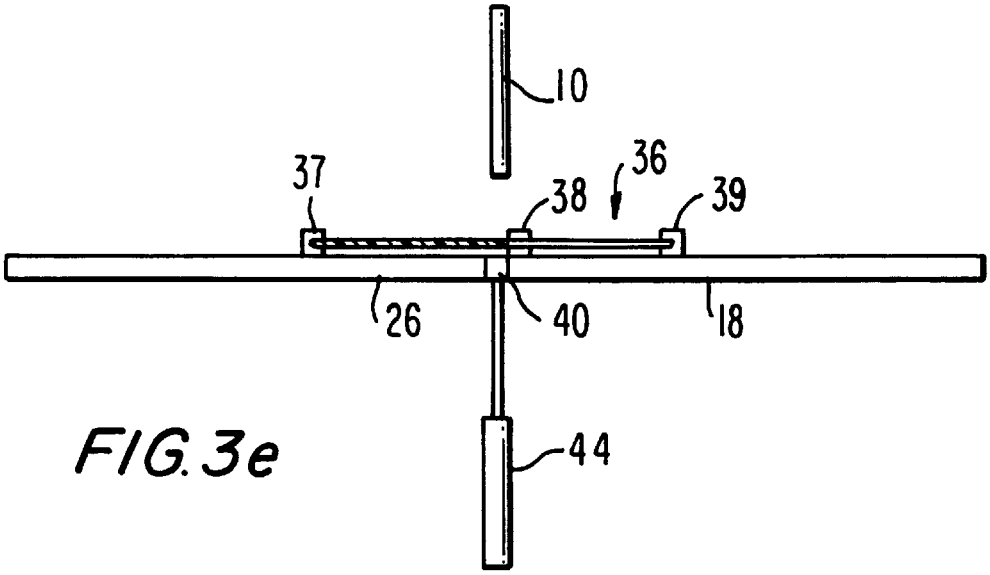
Figure 3F:
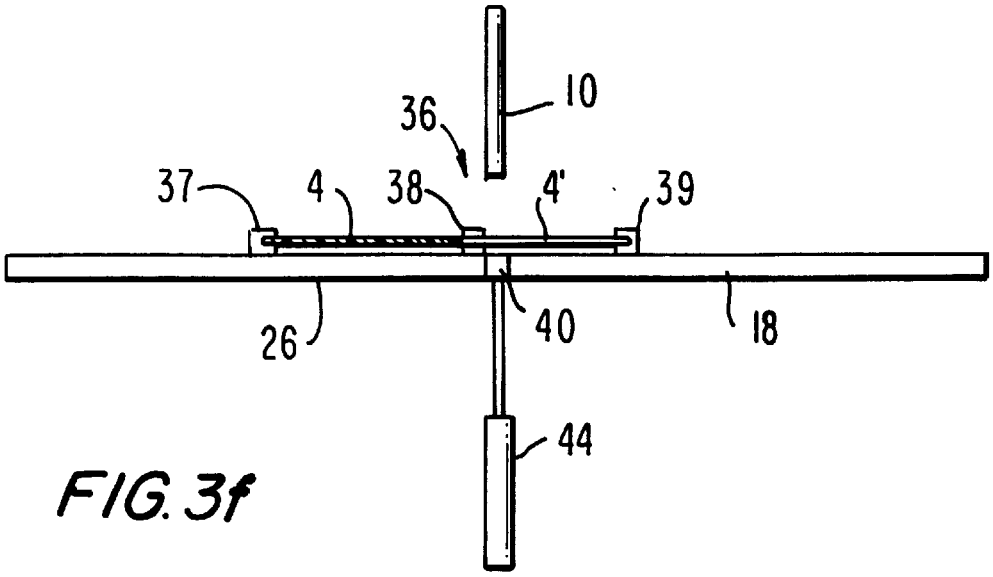
Figure 3G:
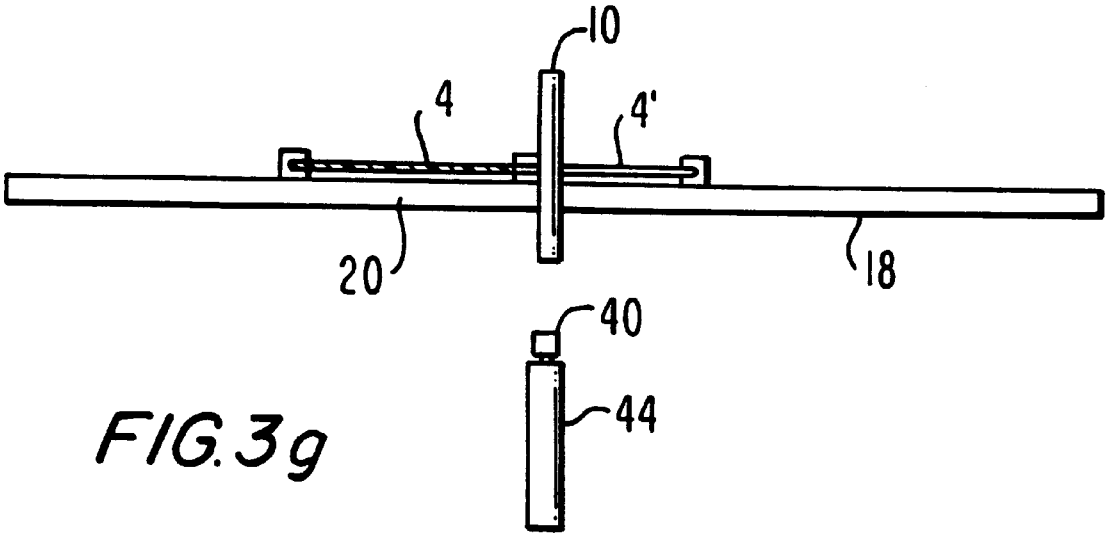
Figure 3H:
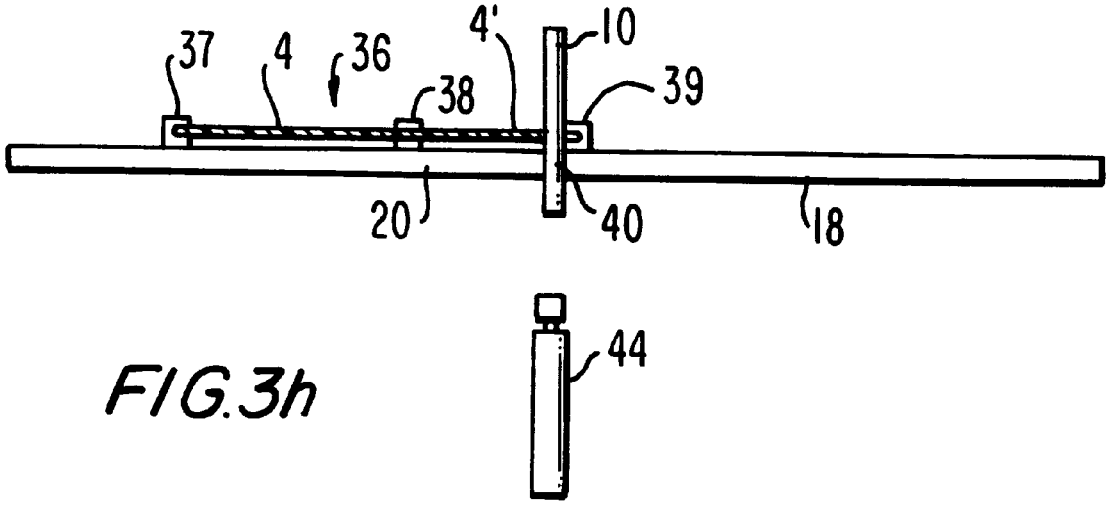
Figure 3I:
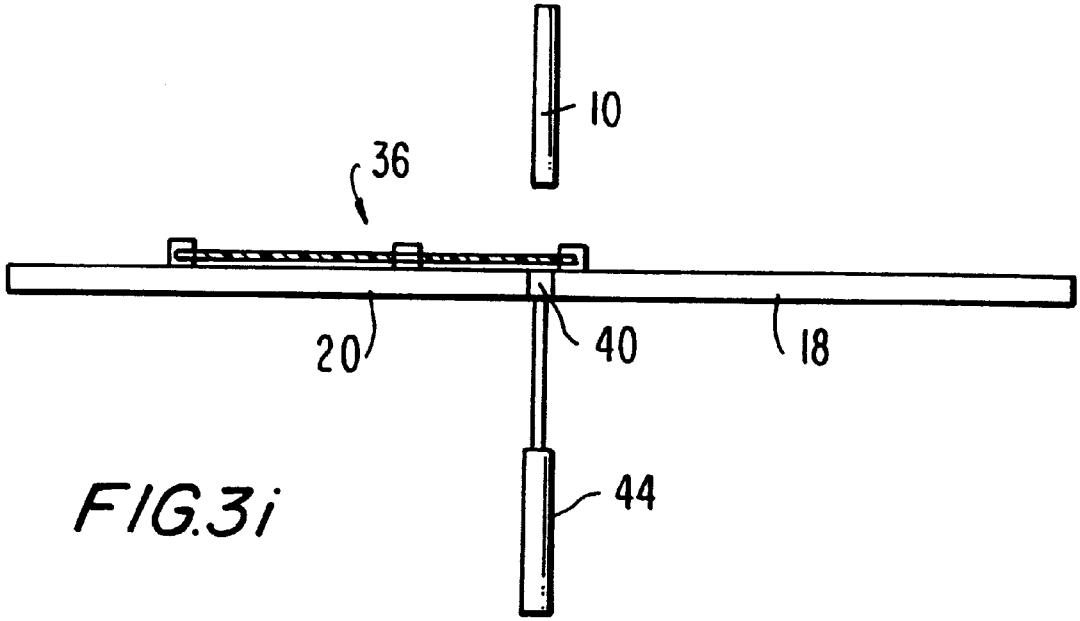
Figure 3J:
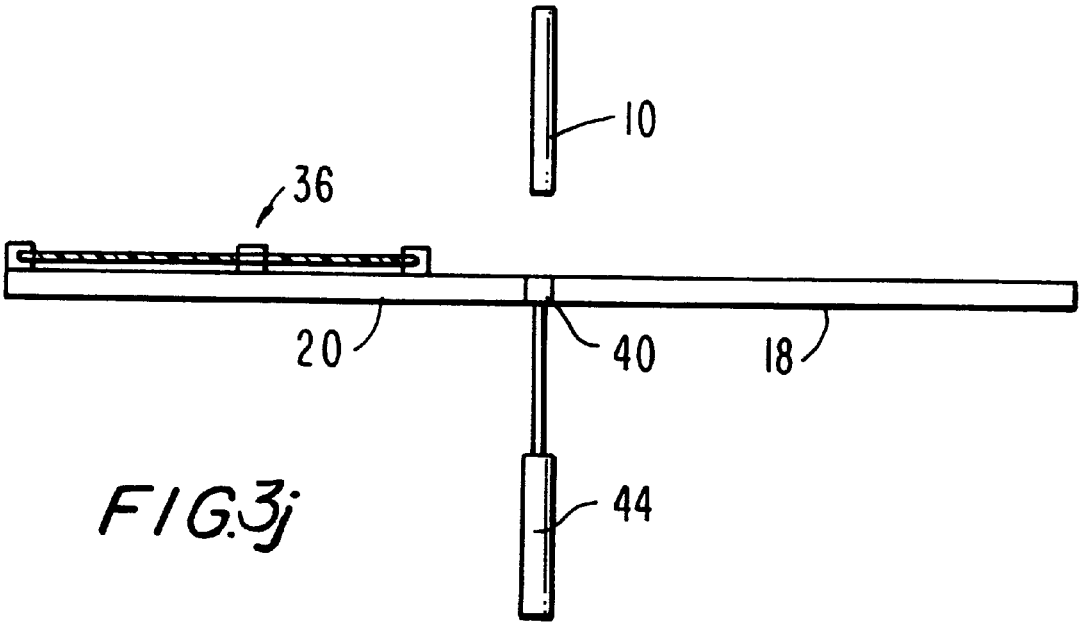

Taping of the harness 36 will now be described with reference to FIGS. 3*a*–3*j*. Referring first to FIG. 3*a*, the harness 36 is on the first conveyor 18, the taping device is in a rest position at a distance from the conveyors, and the bridging cog 40 is positioned in the gap between the first 18 and second 20 conveyors. A first node 37 of the harness 36 can thus traverse from the first conveyor 18 to the second conveyor 20 as shown in FIG. 3*b*. Once the first node 37 is on the second conveyor, the bridging cog 40 is retracted by the piston 44, and subsequently the taping device 10 is displaced into the gap between the conveyors 18,20 as shown in FIG. 3*c*. The first section 4 of harness to be taped is thus received in the slot 8 of the taping device (as shown in FIGS. 1*a* and 1*b*), the taping device 10 being positioned such that its axis of rotation coincides with that of the harness. The taping device wheel 2 is rotated, and simultaneously the first and second conveyors 18,20 transport the harness in the axial direction until the second node 38 arrives at the taping device 10 as shown in FIG. 3*d*. The taping device 10 is then retracted, and subsequently the bridging cog 40 is inserted into the gap between the first and second conveyors as shown in FIG. 3*e*. The second node 38 can then be transported over the bridging cog 40 to the second conveyor 20 as shown in FIG. 3*f*. Referring to FIG. 3*g*, the bridging cog 40 is then retracted and the taping device 10 positioned over the second section 4' of harness to be taped. FIGS. 3*h* and 3*i* correspond to the steps shown in FIGS. 3*d* and 3*e* respectively. FIG. 3*j* shows the completed harness being transported away on the second conveyor.

Advantageously therefore, a simple, automated linear method of taping a multi-node harness is thus provided.

What is claimed is:

1. Method of taping a harness having a section extending between nodes that are supported by support means on a harness transport system, comprising the steps of:

supporting the nodes (37, 38, 39) on support means (34);

transporting the support means and harness on a harness transport system having a first conveyor and a second conveyor;

transferring a first node of a first harness to be taped from the first conveyor to the second conveyor;

inserting a taping device between the first and second conveyors;

taping the harness section; and, prior to transferring the nodes from the first to the second conveyor, inserting a bridging conveyor therebetween to effect the transfer.

2. The method of claim 1 wherein the harness section is taped substantially along the whole length from the first node to a second node.

3. The method of claim 1, wherein subsequent to completion of taping the first harness section, the method further comprises the steps of:

removing the taping device from between the conveyors;

transferring a second node of the harness section from the first conveyor to the second conveyor;

inserting the taping device between the conveyors;

taping a second section of harness.

4. The method of claim 1 wherein the harness is transported along the first and second conveyors in a linear manner.

5. An automated harness making machine comprising a harness transport system for transporting a harness, and a taping device for taping sections of the harness, the transport system comprising pallets or grippers to hold the harness at nodes, and a first conveyor and a second convey, wherein the taping device is insertable between the conveyors for taping of the sections of the harness, and removable from between the conveyors to allow passage of the pallets or grippers from the first conveyor to the second conveyor, the transport system further comprising a bridging conveyor insertable in a gap between the first and second conveyors to enable passage of the pallets or grippers between the first and second conveyors, the bridging conveyor being removable therefrom to enable insertion of the taping device into the gap.

6. The machine of claim 5 wherein the first and second conveyors are linear and aligned with each other.

* * * * *